US012258529B2

(12) United States Patent
Vu

(10) Patent No.: US 12,258,529 B2
(45) Date of Patent: Mar. 25, 2025

(54) ADDITIVE FOR THE COMBUSTION OF SOLID FUELS AND PRODUCTION PROCESS OF THIS ADDITIVE

(71) Applicant: National Key Laboratory For Petrochemical and Refinery Technologies, Hanoi (VN)

(72) Inventor: Thu Ha Thi Vu, Hanoi (VN)

(73) Assignee: National Key Laboratory For Petrochemical and Refinery Technologies, Hanoi (VN)

( * ) Notice: Subject to any disclaimer, the term of this patent is extended or adjusted under 35 U.S.C. 154(b) by 0 days.

(21) Appl. No.: 18/232,779

(22) Filed: Aug. 10, 2023

(65) Prior Publication Data

US 2023/0383207 A1 Nov. 30, 2023

(30) Foreign Application Priority Data

Nov. 21, 2022 (VN) ..... 1-2022-07602

(51) Int. Cl.
*C10L 9/12* (2006.01)

(52) U.S. Cl.
CPC ..... *C10L 9/12* (2013.01); *C10L 2200/029* (2013.01); *C10L 2230/22* (2013.01); *C10L 2290/24* (2013.01)

(58) Field of Classification Search
CPC .. C10L 9/12; C10L 2200/029; C10L 2230/22; C10L 2290/24; C10L 5/04; C10L 1/125; C10L 1/1266; C10L 1/1824; C10L 1/1881; C10L 1/19; C10L 1/191; C10L 1/2227; C10L 1/232; C10L 5/442; C10L 5/445; C10L 10/02; C10L 10/04; C10L 9/10
See application file for complete search history.

(56) References Cited

FOREIGN PATENT DOCUMENTS

WO WO-2007136753 A2 * 11/2007 ..... B01D 53/90

* cited by examiner

*Primary Examiner* — Taiwo Oladapo
(74) *Attorney, Agent, or Firm* — Fulwider Patton LLP

(57) ABSTRACT

The present invention relates to the additive for solid fuel combustion processes (coal, biomass) that both improves fuel efficiency, reduces fuel consumption, and has the ability to prevent sludge formation in combustion chamber and reduce pollutant emission, ensuring stable and highly efficient furnace operation even when using bad-quality fuel. The additive includes the activator component with high polarity; the active component capable of generating active sites; the auxiliary component capable of promoting the generation of active centers; the stabilizing component able to regulate the physicochemical properties and helping to create a stable additive according to the ratio of components (% mass) as follows:

Activator component: 20-30
Active component: 50-60
Auxiliary component: 5-9
Stabilizing component: 1-5, and
Solvent: suitable In addition, the invention also relates to the production process for this additive.

7 Claims, No Drawings

ADDITIVE FOR THE COMBUSTION OF SOLID FUELS AND PRODUCTION PROCESS OF THIS ADDITIVE

CROSS-REFERENCES TO RELATED APPLICATIONS

This application claims priority from Vietnam Patent Application No. 1-2022-07602, filed Nov. 21, 2022, the content of which is incorporated by reference herein in its entirety.

FIELD OF INVENTION

The present invention relates generally to the additive for the combustion of solid fuels (coal, biomass) in clinker production, chemical production, thermal power, metallurgy, as well as any other industrial processes using solid fuels, which not only improves fuel efficiency and reduces fuel consumption, but also has the ability to prevent deposit on the walls of the combustion chamber and reduce pollutant emission, ensuring the furnace to operate stably and with high efficiency, even when the quality of the fuel input is bad. In addition, the invention also relates to the production process for this additive.

BACKGROUND OF INVENTION

During operation, the combustion chambers (furnace wall, roof and tail end, etc.) and the tube trusses (including heat-utilizing unit, superheater, air dryer, etc.) of the boilers using solid fuels, especially the pulverized coal boiler and the circulating fluidized bed boilers, clinker kilns, metallurgical furnaces, etc. are often slagged or roughened. For example, during the process of combusting coal, the unburnt materials in the fuel, along with a small amount of unburnt carbon, will be present in the gas. Some of these materials fall harmlessly onto the furnace floor while some are passed through the boiler and collected in ash hopper or discharged. In general, this type of ash does not interfere with the operation of the boiler, however, some of which will stick to relatively colder surfaces in different regions along the boiler. This ash deposition is influenced by many variables, such as the tendency of the ash to convert into slag, the moisture content in the fuel, the temperature characteristic in the boiler, the velocity and pattern of the exhaust flow, etc. This type of ash formation tends to inhibit heat transfer and disrupt the exhaust gas flow, resulting in reduced boiler efficiency, increased exhaust gas temperature and, in some cases, boiler shutdown. Furthermore, slag is corrosive to boilers, which can lead to unexpected failure. It is estimated that slag incidents and problems related to excessive slag and soot cause damage to the global energy field, for example, for the electricity field alone, several billion dollars per year are cost due to reduced power output and equipment maintenance.

To overcome this challenge, it is necessary to often pause the furnace operation for cleaning, in order to put the furnace's performance to its original state. In fact, service companies in the furnace fueled by coal sector report that regular slag removal can increase furnace efficiency by up to 4%, in addition to extending the life span of the furnace. The methods used to treat slag accumulation are diverse, including chemical methods, soot blowers, sound waves, hydraulic blasters, $CO_2$ dry ice blasters, hammer drill, hoe, etc. Each method has its own advantages and disadvantages, but is all costly and affects production, due to the need to stop the furnace, and can cause unsafety for the executors and/or risk of causing abrasion of the surface to be cleaned.

Especially, in the reality that the quality of raw materials is increasingly declining due to all resources being gradually exhausted, the use of low-quality coal for heat-generating processes is sometimes a mandatory choice. On the other hand, the replacement of fossil fuels with fuel from biomass, which has relatively different compositions and properties to coal, is becoming a trend in the world. This makes the problem of ash formation even more complicated. Besides, the use of fuel with unstable quality is a big challenge for the stable operation of furnaces that are designed for good-quality fuel.

In Vietnam, coal-fired power has been playing a major role in the national electricity output. In general, coal-fired power production accounts for about 50% of national electricity production. Up to now, at most of the thermal power plants in Vietnam, the ash and slag treatment processes in the combustion chambers and steam pipes are still periodically carried out, according to one of the above-mentioned treatment methods. In 2000, the solution to reform the structure of the burner assembly, which has been applied for a long time in the world, was put into application at boiler No. 4 of Ninh Binh Thermal Power Plant, which helped reduce the phenomenon of the slag formation in the combustion chamber of the boiler, which increases the operating cycle (from more than 1 month up to 4 months). The principle of the solution is to take advantage of the solid stream and the dilute stream to create an effective combustion mechanism (early ignite, burn out), yet do not generate the slag in the furnace. In other words, coal and gas are burned in two different streams, creating an isolation layer from the furnace wall, causing the generated slag not to stick to the furnace wall but to fall down. However, the widespread application of this solution is limited because it not only requires intervention in the combustion chamber's structure, but also costs investment in the the furnace reform.

Therefore, research and development of solutions related to the prevention of slag formation in the furnace, increasing the efficiency of solid fuel combustion in general and solid fuel with low-quality in particular, in order to achieve economic, technical and environment efficiency while ensuring efficient operation of furnaces using solid fuel, remains imperative.

The solution uses a coal-fired additive, including an additive that improves the melting/sintering properties of the ash by changing the ash composition to make the ash layer more porous and softer, resulting in easier cleaning and maintenance, is known. These additives are mainly inorganic compounds (mineral additives), containing metal oxides, such as additives containing MgO, kaolin, silanite, serpentine, iron quacsite, by-products of processing metals ($MnO_2$, CaO, $CeO_2$, $Fe_2O_3$, CuO và ZnO (Gong, X., Z. Guo, and Z. Wang. *Reactivity of pulverized coals during combustion catalyzed by $CeO_2$ and $Fe_2O_3$. Combustion and Flame,* 2010, 157(2):351-56; Gong, X., Z. Guo, and Z. Wang. *Variation on anthracite combustion efficiency with CeO2 and and $Fe_2O_3$ addition by differential thermal analysis (DTA). Energy,* 2010, 35(2):506-11; Li, X. G., B. G. Ma, L. Xu, Z. T. Luo, and K. Wang. *Catalytic effect of metallic oxides on combustion behavior of high ash coal. Energy and Fuels,* 2007, 21(5), 2669-2672) và các hop chất kim loại kiềm ($NaNO_3$, $NClO_4$, $KNO_3$, $KClO_3$ và $K_2CO_3$) (Fangxian, L., L. Shizong, and C. Youzhi. *Thermal analysis study of the effect of coal-burning additives on the combustion of coals. Journal of Thermal Analysis and calorimetry,* 2009, 95

(2):633-38; He, X. M., J. Qin, R. Z. Liu, Z. J. Hu, J. G. Wang, C. J. Huang, T. L. Li, and S. J. Wang. *Catalytic combustion of inferior coal in the cement industry by thermogravimetric analysis. Energy Sources, Part A: Recovery, Utilization and Environmental Effects,* 2013, 35(13), 1233-1240; Kim, Y. K., L. F. Hao, J. I. Park, J. Miyawaki, I. Mochida, and S. H. Yoon. *Catalytic activity and activation mechanism of potassium carbonate supported on perovskite oxide for coal char combustion. Fuel,* 2012, 94:516-22; Yin, K., Y. M. Zhou, Q. Z. Yao, C. Fang, and Z. W. Zhang. *Thermogravimetric analysis of the catalytic effect of metallic compounds on the combustion behaviors of coals. Reaction Kinetics, Mechanisms and Catalysis,* 2012, 106 (2):369-77; C. S. Li, K. Suzuki, *Steam reforming of biomass tar producing $H_2$-rich gases over Ni/MgOx/CaO1-x catalyst, Bioresource Technology,* 2010, 101(1):597-100; Sahu, S. G., A. Mukherjee, M. Kumar, A. K. Adak, P. Sarkar, S. Biswas, H. P. Tiwari, A. Das, and P. K. Banerjee. *Evaluation of combustion behaviour of coal blends for use in pulverized coal injection (PCI). Applied Thermal Engineering,* 2014, 73(1):1014-21; Wenqing Li, Liying Wang, Yu Qiao, Jian-Ying Lin, Meijun Wang, Liping Chang, *Effect of atmosphere on the release behavior of alkali and alkaline earth metals during coal oxy-fuel combustion, Fuel,* 2015, 139, 164-170; Zou, C., and J. Zhao. *Investigation of iron-containing powder on coal combustion behavior. Journal of the Energy Institute,* 2016, 1-9).

When entering the combustion zone, the fuel additives are heated to a high temperature (1300-1600 K or higher), resulting in their molecular bonds being broken to form atoms and chemically active radicals that enhance the combustion of coal, through promoting the oxidation reactions of substances that are difficult to oxidize and modifying the reaction to accelerate the release of volatiles from coal (Shen, B., and Qinlei. *Study on MSW catalytic combustion by TGA. Energy Conyers. Manage.,* 2006, 47, 1429; Li, C., & Suzuki, K. *Tar property, analysis, reforming mechanism and model for biomass gasification—An overview. Renewable and Sustainable Energy Reviews,* 2009, 13(3), 594-604; Li, L., Z. C. Tan, S. H. Meng, S. D. Wang, and D. E Wu. *Kinetic study of the accelerating effect of coal-burning additives on the combustion of graphite. Journal of Thermal Analysis and calorimetry,* 2000, 62 (3):681-85). This process is accompanied by multiple micro-explosion and additional energy release, which can be visually determined from the increased brightness of the fireball (the Lenard effect).

Specifically, after decomposition, these oxides are formed, which act as active oxygen carriers for the catalytic combustion of coal. At higher temperatures, the active oxygen creates the active center, which enables the carbon around it to burn faster, and at the same time, the surface resistance of the coal particles is also reduced due to the cavities created by combustion and enhanced oxygen diffusion. This mechanism allows close contact between oxygen and coal, thereby improving the burning rate of coal while lowering the ignition temperature of coal. For most pulverized coal, the supply of oxygen must be timely, so that a negative impact on the coal combustion reaction is prevented, giving improved coal combustion. The catalytic effect on the combustion of pulverized coal leads to the following results: (i) Increased combustion reactivity due to reduced ignition temperature and increased combustion rate; (ii) Improved combustion of unburnt carbon in the ash and accelerating release of heat from the coal; and (iii) Reduced pollutants in the exhaust gas, such as NOx, $SO_2$, CO and PM.

In addition, CoMate Ash Modifier derived from clay minerals is injected with compressed air into the furnace's combustion zone. First of all, it acts as an active ash modifier in the combustion of carbon monoxide (CO) in a combustion medium. CoMate is not considered as a fuel additive as it is primarily designed for injection off the fuel supply. Once activated, it will combine with a small fraction of the ash normally to form a hard residue. This process removes the hardness and/or stickiness of the ash material, allowing for much easier ash removal during operation.

However, this application has some limitations. First, the modifier needs to be mixed with coal, at a rate of about 5-10%. As a rule, since the modifier accounts for 5-10% of the weight of coal, combustion produces a greater amount of ash than when no modifier is used. This ash contains coal combustion products and products from the thermal transformation of mineral additives. Second, the calorific value of the mixture of coal and modifier is lower than that of coal without modifier, and more energy is required in the preparation and loading of the modifier into the furnace.

To overcome the disadvantages of inorganic additives, some organic additives which are based on alcohols and ethers, and highly reactive, resulting in significantly lower utilization rates (about 0.5% total mass relative to coal fuel), has been proposed (V. E. Messerle, G. Paskalov, K. A. Umbetkaliyev, and A. B. Ustimenko, *Application of Organic Fuel Additives to Enhance Coal Combustion Efficiency, Thermal Engineering,* 2020, Vol. 67, No. 2, pp. 115-121). However, new studies are at the stage of the experimental model (in the combustion chamber with a diameter of 0.2 m and a height of 0.9 m), and the document only gives results on the reduction performance of CO and NO emission due to additives. There is no quantitative data on the effect of organic additives on fuel economy, nor on the prevention of slag deposition.

Recently, in Vietnam, several results of experimental application of coal-fired technology with 2 kinds of additives, Reduxco of Poland and Eplus of Taiwan, to increase efficiency and reduce pollutant emissions for coal-fired thermal power plants, at the boiler No. 3 with capacity of 300 MW (pulverized coal furnace (PC) type, using Anthracite coal fuel), of Hai Phong thermal power plant, have been published. Eplus is a coal-fired liquid catalyst, based on the inorganic nano-material titanium dioxide ($TiO_2$) in organic solvents. Reduxco is a catalyst and a reaction product of acetic acid, iron, n-butanol, n-propanol and isopropanol. According to the manufacturer's data, Reduxco catalyst in hydrocarbon fuel results in a decrease in the activation energy of the hydrocarbon fuel oxidation reaction, as well as the formation of additional OH groups, while allowing a rate of combustion to increase and facilitating combustion after soot particles form in the engine cylinders (Jerzy Cisek, Szymon Lesniak, Winicjusz Stanik and Wlodzimierz Przybylski, *The Synergy of Two Biofuel Additives on Combustion Process to Simultaneously Reduce NOx and PM Emissions, Energies* 2021, 14, 2784). The test results of these two additives for a coal-fired boiler show that both Eplus and Reduxco additives help increase the boiler efficiency by about 1% on average, reduce the coal consumption by about 2.6%, reduce the content of the remaining carbon in the ash by about 2.4%, and reduce the concentration of NOx and SOx in the exhaust gas by an average of 6.3% and 12.2%, respectively. According to the test authors, when mixed with coal, these additives react with water, producing a large amount of free radicals that make redox reactions with carbon in the furnace faster, stronger, and more burned out, thus, resulting in reduction in generation of combustion by-products such as fly ash and bottom slag (*Report on the results of the nation-level project "Research and testing of burning coal with additive to increase efficiency and reduce pollutant emissions for coal-fired thermal power plants*", Code KC.05.19/16-20, *Under the Energy Technology Development and Application Research Program, code KC*.05/16-20). Economically, according to calculation, putting Eplus additive to application will bring about a net profit of about 15 billion VND/year by saving fuel and buying additives for the 300 MW unit, while with Reduxco additive, the cost saved due to reduced fuel consumption cannot make up for the additional cost of purchasing additive.

As mentioned above, certain additives may have desirable qualities for reduced pollutant emission or increased combustion efficiency, but to date, no additive has been able to simultaneously provide outstanding economic-technical and environmental efficiency in the operation of solid fuel furnaces. In addition, the problems related to the prevention of deposits on the combustion chamber's wall have not been solved.

Therefore, there is an urgent need to find an additive that has properties to improve fuel combustion efficiency, reduce fuel consumption, and be able to prevent deposits on the combustion chamber's wall and reduce pollutant emissions, which ensures stable operation of the furnace even when using fuel of bad quality (decreased quality), in order to bring about significant economic-technical and environmental efficiency, solving above-mentioned problems.

SUMMARY OF INVENTION

The purpose of the present invention is to propose an additive capable of improving fuel combustion efficiency, reducing fuel consumption, and also having the ability to prevent deposits on the combustion chamber's wall and reduce pollutant emission, ensuring stable operation of the furnace and high efficiency even when using bad quality fuel, in order to overcome the disadvantages of known combustion additive.

To achieve the foregoing, the present invention provides an additive comprising an activator component with high polarity, an active component capable of generating active sites, an auxiliary component capable of promoting the generation of active centers, s stabilizing component helping to regulate the physicochemical properties and to create a product with stable properties.

More specifically, the present invention provides an additive comprising the following proportions (% mash) as follows:

Activator component: 20-30,
Active component: 50-60,
Auxiliary component: 5-9,
Stabilizing component: 1-5,
Solvent: suitable.

in which, the activator component is a mixture of highly polar substances, including a compound containing benzimidazole molecule combined with an oxadiazole ring (Benzimidazole molecule hybrid with oxadiazole ring) and a carbamite compound.

The active component is a solution containing 1 mass fraction of an ammonium salt of carbonic acid, 2 mass fractions of an ammonium salt of a carboxylic acid with 2 to 5 carbon atoms, in demineralized water.

The auxiliary component includes urea and demineralized water.

The stabilizing component is a complex of fatty acid alkyl esters, glycerol esters, organic acid esters with 2, 3 or 5 carbon atoms, isopropanol.

The solvent is a mixture of isopropanol and butanol, mixed together in an appropriate proportion.

In a preferred option, the present invention provides an additive for a solid fuel furnace, comprising the following components in the following proportion (% mass):

Activator component: 24-26,
Active component: 54-66,
Auxiliary component: 8-9,
Stabilizing component: 1-2,
Solvent: suitable.

After extensive research, the inventor has discovered that the above-mentioned additive has a synergistic effect in creating active sites in the combustion chamber, which can achieve multiple goals simultaneously, including: (i) increasing the speed of the combustion chain reaction in the combustion chamber, promoting the complete combustion of solid fuel, leading to reduced fuel consumption, and at the same time providing high combustion efficiency even when fuel used is of bad quality; (ii) significantly reducing unburnt carbon in fly ash and improving liquid slag treatment; (iii) reducing pollutant in exhaust gas; (iv) cleaning furnace surfaces and pipes from soot, dust and ash, which improves heat transfer in the furnace.

In addition, in another option, the present invention provides a production process of this additive by adding the activator component, the aulixiary component, the stabilizing component to the active component, respectively, at a ratio (mass %):

Activator component: 20-30,
Active component: 50-60,
Auxiliary component: 5-9,
Stabilizing component: 1-5, After that, stirring well to obtain a homogeneous, transparent mixture, and then add a suitable amount of solvent to the resulting mixture to obtain a finished product as an additive.

DETAILED DESCRIPTION OF INVENTION

The additive under this invention includes activator component, active component, auxiliary component, stabilizing component, and solvent.

More specifically, the additive of the present invention includes the following components in proportion (% mass) as follows:

Activator component: 20-30
Active component: 50-60
Auxiliary component: 5-9
Stabilizing component: 1-5
Solvent: suitable In which, the active component consists of demineralized water, and the mixture comprising 1 mass fraction of the ammonium salt of carbonic acid and 2 mass fractions of the salt of carboxylic acid with 2 to 5 carbon atoms.

It is preferable if the content of the active component in the additive ranges from 50% to 60% by mass, more preferably between 52% and 58% by mass, most preferably between 54 and 56% by mass.

The auxiliary component includes urea and demineralized water.

It is preferable if the content of the auxiliary component in the additive ranges from 5% to 9% by mass, more preferably between 6% and 9%, most preferably between 8 and 9% by mass.

The stabilizing component includes the mixture of fatty acid alkyl esters, glycerol esters, organic acid esters with 2, 3 or 5 carbon atoms, isopropanol; these components are mixed together according to the respective volume ratio 5%:5%:10%:80%.

The term "fatty acid alkyl ester" as mentioned in this description referred to in this specification refers to the mixture of fatty acid methyl esters derived from vegetable oils obtained by the transesterification of animal fat and vegetable oils with methanol.

The term "the ammonium salt of carboxylic acid with 2 to 5 carbon atoms" as mentioned in this description refers to the salts of ammonium acetate, ammonium propionate, ammonium butyrate, ammonium pentanoate.

The term "the ammonium salt of carbonic acid" as mentioned in this description refers to the ammonium carbonate salt.

The term "the glycerol ester" as mentioned in this description refers to the glycerol triacetate ester.

The term "the ester of an organic acid with 2, 3, or 5 carbon atoms" as used in this description refers to the esters of ethyl acetate, ethyl lactate or ethyl levulinate.

It is preferable if the content of the stabilizing component in the additive ranges from 1% to 5% by mass, more preferably between 1 and 3%, most preferably between 1 and 2% by mass.

The solvent used in the additive is the mixture of isopropanol, butanol, mixed together in a volume ratio of 50%:50%, more preferably 70:30%, most preferably 90%:10%.

The solvent is added to the mixed components of the additive to reach 100%.

The activator component is the mixture of highly polar substances including:

(i) compound containing benzimidazole molecule hydrid with oxadiazole ring, and carbamite compound; and (ii) solvent to dissolve the above compounds.

The term "Compound containing benzimidazole molecule hybrid with oxadiazole ring" as used in this invention refers to compounds having the structural formula as disclosed in the non-patent document (Mohammad Rashid, Obaid Afzal and Abdulmalik Saleh Alfawaz Altamimi; *Benzimidazole molecule hybrid with oxadiazole ring as antiproliferative agents: in-silico analysis, synthesis and biological evaluation; J. Chil. Chem. Soc.,* 66, No. 2 (2021)). Methods for the preparation of these compounds are also disclosed in this document.

More specifically, the compounds containing benzimidazole molecule hybrid with a preferred oxadiazole ring mentioned in this present invention are at least one selected compound from a group comprising a benzimidazole molecule bearing a diethylamino methyl, diphenylamino methyl, 4-methylpiperazine-1-yl methyl of oxadiazole.

According to a preferred option of the present invention, a benzimidazol compound bearing a diphenylamino methyl derivative of oxadiazole has the chemical name: 1-(1H-benzo[d]imidazol-2-yl)-3-(5-((diphenylamino)methyl)-1,3,4-oxadiazol-2-yl) propan-1-on, is preferred.

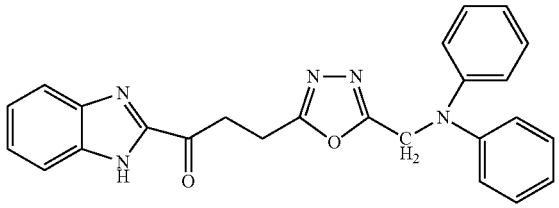

Compound 1-(1H-benzo[d]imidazol-2-yl)-3-(5-((diphenylamino)metyl)-1,3,4-oxadiazol-2-yl)propan-1-on The term "carbamite compound" used in this invention refers to a compound (1,3-dietyl-1,3-di(phenyl)urea), which is a commercially available, commercially available product with purity ≥98% and having the structural formula:

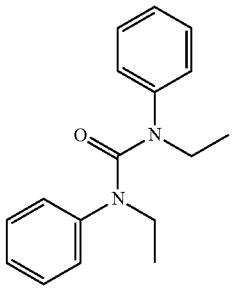

Compound 1,3-dietyl-1,3-di(phenyl)urea

The mass ratio of benzimidazole molecule hybrid with oxadiazole ring and carbamite compound, in the respective activator components is (10-20%):(80-90%); more preferably (12-18%):(82-88%); most preferably (14-16%):(84-86%);

The solvent used in the activator component is selected from a group comprising the organic solvents ethyl acetate, ethyl lactate, most preferably ethyl lactate. It is preferable that the solute content of the solvent ranges from 20% to 40%, more preferably 25-35%, most preferably 27-33%.

The content of the activator component in the additive ranges from 20% to 30% by mass, more preferably between 22 and 28%, most preferably between 24 and 26% by mass.

The additive of the present invention is prepared by successively adding the activator component, the auxiliary component, and the stabilizing component to the active component in the proportions of ingredients (% mass):

Activator component: 20-30

Active component: 50-60

Auxiliary component: 5-9

Stabilizing component: 1-5

After that, stir well to obtain a homogeneous, transparent mixture, and then add solvent to the resulting mixture to obtain a finished product as additive.

According to a preferred option, the additive of the present invention is produced by a process that includes the following specific steps:

Step 1: Prepare the Activator Component

Mix a solution containing a mixture of benzimidazole molecule hybrid with oxadiazole ring and carbamite compound in a solvent selected from a group comprising the organic solvents ethyl acetate, ethyl lactate, most preferably ethyl lactate, to obtain a 20-40% solution containing a mixture of benzimidazole molecule hybrid with oxadiazole ring and carbamite compound in the solvent.

Step 2: Prepare the Active Component

A mixture comprising 1 mass part of ammonium carbonate, 2 mass parts of ammonium salt of a carboxylic acid selected from a group comprising ammonium acetate, ammonium propionate, ammonium butyrate, or ammonium pentanoate, added to an 80% solution of the iso-propanol in demineralized water, combined with stirring to obtain the active ingredient with a salt concentration of 30%.

Step 3: Prepare the Auxiliary Component

Stir a mixture of urea in demineralized water to obtain the auxiliary component in the form of a 40% solution of urea in demineralized water.

Step 4: Prepare the Stabilizing Component

First, prepare mixture A, comprising an ester of an organic acid with 2, 3, or 5 carbon atoms selected from a group comprising ethyl acetate ester, ethyl lactate or ethyl levulinate, and isopropanol, in similar volume proportions, corresponding to a ratio of 1:8. Stir to obtain a homogeneous mixture.

Next, prepare mixture B comprising methyl ester of fatty acid from vegetable oil and glycerol triacetate ester in a volume ratio of 1:1. Stir to obtain a homogeneous mixture.

Add mixture B to mixture A in a volume ratio of 1:9 to obtain mixture C. Stir mixture C by ultrasonic transducer to homogenize the mixture, then obtain the stabilizing component composed of a mixture of methyl ester of fatty acid from vegetable oil, glycerol triacetate ester, ester of an organic acid with 2, 3, or 5 carbon atoms selected from a group comprising ethyl acetate, ethyl lactate or ethyl levulinate ester, and isopropanol, in a volume ratio of 5%:5%:10%:80%, respectively.

Step 5: Produce the Additive

Add the activator component, the auxiliary component, the stabilizing component to the active component at the specified mass percentage, then stir to obtain a homogeneous, transparent mixture, and then add the solvent into the resulting mixture to obtain a finished product as an additive.

According to the present invention, the additive is injected quantitatively into the furnace gas supply system, as a solution in demineralized water, through a nozzle.

The ratio of the use of additive to the amount of coal used for the furnace is from 5-8 mL of additives/ton of coal, equivalent to the ratio of using one liter of additive for 125-200 tons of coal, more effectively one liter of additive for 143-200 tons of coal, most effectively one liter of additive for 167-200 tons of coal.

In all coal-fired heating processes, it is important to strive for complete combustion of the fuel at the maximum speed. The molecules of fuel and oxygen, moving in different directions at high speed, collide with each other, and the more often they collide, the faster the reaction takes place.

Combustion is a chain reaction with branching chains, where each active molecule creates several new active sites, accelerating the reaction. The collision of the active molecules with enough energy to weaken and destroy the intramolecular bonds leads to the formation of new molecules. If the atoms are free to participate in the reactions, since the activation energy will not be large, the chain reaction of combustion takes place much faster.

The presence of active hydrogen (H), produced by the introduction of additive into the combustion chamber space allows to increase the rate of the combustion chain reaction. Each hydrogen atom produces three new hydrogen atoms and two molecules of water vapor. The three active hydrogen atoms formed start to work along the same chain, increasing the rate of the reaction to an exponential order of 3.

The combustion of carbon monoxide (CO) proceeds like a branching chain reaction. In the flame of carbon monoxide, there are atomic oxygen and hydrogen, as well as the hydroxyl group (OH), which are the initiators of the chain reaction.

The combustion of hydrocarbons takes place with the formation of intermediate products, such as hydroxyl, formaldehyde, methyl alcohol, and is combined with the thermal decomposition (cracking) of the hydrocarbons with the release of soot, giving the flame a luminous properties.

In fact, the combustion rate of a combustible gas is not limited by the rate of chemical reaction, but is determined by agitation—the physical process of mixing the combustible gas with air.

Good contact between the fuel and the oxidant and the formation of a good mixture are the most important conditions for complete combustion and complete combustion of the fuel. The higher the temperature under the same conditions is, the more efficient the furnace will be and the more fuel efficient it will be. In turn, an increase in the temperature of the flame core has a strong effect on the rate of the combustion chain reaction, increasing it by millions of times.

The additive of the present invention brings its properties into the combustion chain, thereby increasing the degree of complete combustion of the fuel in the kinetic and intermediate regions of combustion, decreasing in the diffusion region. The presence of the additive of the present invention leads to a reduction in the size of the flame and an increase in its luminescence. This allows to reduce heat transfer by convection and increase heat transfer by radiation. Radiant heat transfer is hundreds to thousands of times more efficient than convection.

Specifically, when the additive of the present invention is put into the combustion chamber, the activator component containing two very polar compounds that are benzimidazole molecule hybrid with oxadiazole ring and a carbamite compound, which promotes the property related to the very high electron polarization of ions, will interact with the air-fuel mixture at the initial stage of flame development, ensuring that residual negative ions in the combustion chamber to rapidly accumulate, creating pressure electrostatic repulsion of charges of the same sign. The active component has an effect equivalent to the electrostatic field on everything it comes into direct or indirect contact with. This formation of electrostatic pressure is due to the conversion of the thermal energy of the molecules during combustion into ionic potential energy in the electrostatic charge field space. Under the action of the electrostatic field and in the presence of the active component and the auxiliary component, active hydrogen is released, producing a variety of positive effects, as detailed below.

First, during combustion, active hydrogen is released. The movement and collision of the active hydrogen atoms with the $O_2$ and $H_2$ elements will produce three other active hydrogen atoms and a water molecule. Just like that, the new active hydrogen atoms continue to create 3 other active hydrogen atoms, when they collide:

$$H+O_2+3H_2 \rightarrow 3H+2H_2O$$

Active hydrogen splits hydrocarbon bonds by hydrocracking. Thanks to that process, shorter hydrocarbon molecules are formed, which are more easily oxidized, with complete combustion of CO.

$$2C+O_2=2CO;$$

$$2CO+O_2=2CO_2.$$

Simultaneously, with the release of water and, accordingly, with an increase in the release of heat, according to Le Chatelier's principle—at the temperature higher than 1000° C., water vapor dissociates into hydrogen and oxygen, according to the reaction: $2H_2O \rightarrow 2H_2+O_2-136$ kcal.

Hydrogen released from water is less active than hydrogen released from the additive, but it also contributes to partial separation of hydrocarbons.

Thanks to the combustion of carbon monoxide and other combustible substances, the thermal effect increases and the rate of emission of harmful substances into the atmosphere decreases.

As a result of hydrocracking, the oxidation of the fuel is improved; the physical structure of the fuel and its rheological properties change: the intermolecular bonds are reduced; the homogeneity of mixing fuel with air and its atomization are significantly increased, which significantly optimizes the thermodynamics of the combustion of the fuel-air mixture. All these effects lead to an increase in the degree of complete combustion of the fuel. The result is:

- Reduce the size of the flame and greatly reduce the fuel consumption. Under normal conditions, the fuel will burn out at the tail end of the burner, however, in the presence of the additive, it will burn in the furnace, increasing the heat transfer to the right place.
- Reduce the size of the flame, making the flame less likely to touch the heat-receiving parts, resulting in a significant reduction in the wear of the combustion chamber's material due to heating. As a result, there is a significant increase in the service life of the heat-receiving parts.
- The color of the flame changes, with a lot of emission of blue-white light, leading to a change in the mode of heat transfer, from convection to radiant heat transfer. Radiant heat transfer leads to a significant reduction in the degree of heating of the furnace wall. Thus, the heat loss on the furnace wall is greatly reduced. As a result, the heat released during combustion is almost entirely used to heat the receiving plates (e.g., steam pipes in a boiler).

The result of the process is more complete combustion of the fuel and increased radiative heat transfer, and reduced heat loss carried by the exhaust gases.

Second, as a rule, hydrocarbons stick to the heated surface are oxidized molecules (bitumen) with a negative (−) charge. The active hydrogen, released from the additive of the present invention, at the temperature of 40-50° C., contains $H^+$, thereby producing a cleaning effect, i.e. recovery of oxidized molecules on the heating surface at fairly low temperature, according to the reaction:

$$2R—CHO^-+2H^+ \rightarrow 2R—CH_3+O_2.$$

Therefore, slag—or oxidized component (in the form of bitumen), after being hydrogen treated (recovered) is easily dissolved in hydrocarbons. At high temperature, due to increased kinetic energy, the time of this reaction is significantly reduced. Therefore, possessing electrostatic and detergent properties, the additive of the present invention cleans heat-exposed surfaces (combustion chamber, heat transfer plate, chimney, etc.) from soot, and other deposits, increasing the heat transfer capacity of the heat transfer plates themselves (in the case of boilers), while preventing their further formation on the surface.

The active hydrogen atom has a very small atomic radius and easily penetrates the intercrystalline lattice of metals, and sometimes, especially in large lattice, can even penetrate the lattice by its high kinetic energy. By such penetration, the molecules create a layer of hydrogenation on the surface of the positively charged (+) metal. The H+ in the metal and the active H+ supplied from the additive of the present invention repel each other. This type of cleaning property of the additive allows the nozzles to operate for a long time without the formation of soot, which improves the atomization of the injected fuel itself and the its complete combustion process. Such cleaning properties begin to take effect eight days after the start of the use of the additive.

Third, when burning coal, the additive is supplied to the combustion zone in the form of a finely dispersed liquid solution, even in the vapor state, which greatly increases the contact area of the additive, meaning that it improves combustion and reduces harmful emissions of CO and nitrogen oxides.

The main physical parameter in the combustion of any fuel is its calorific value Q. According to Mendeleev's formula (for solid and liquid fuels), the high calorific value ($Q_{max}$) and low calorific value ($Q_{min}$) are represented by the equations below:

$$Q_{max}=81C+300H+26(S—O)$$

$$Q_{min}=81C+246H+26(S—O)-6W$$

in which: C—carbon; S—sulfur participating in combustion (volatile sulfur); O—oxygen; H—hydrogen; W—ambient humidity and fuel moisture.

From the above formulas, we see that the largest coefficients (300 and 246) in the formula in which the element is multiplied is hydrogen. As stated above, for normal combustion, at 1000° C. and above, water dissociates according to Le Chatelier's principle: $2H_2O \leftrightarrow 2H_2+O_2-136$ kcal. Thus, hydrogen capture at flame core temperatures up to 1500° C. even without increasing pressure, inducing hydrogenation that partially decomposes hard coal and soot, forming liquid fuel, which is ignited immediately with less ash and CO emissions, and more heat released.

The additive of the present invention has the effect of gradually lowering this threshold from 1000° C. to 300° C., resulting in a gradual increase in the amount of oxygen and hydrogen in the combustion zone, and after 48-72 hours, depending on the type of fuel and furnace and boiler, it may be necessary to adjust the furnace air supply in the downward direction. In other words, with the inclusion of the additive of the present invention in the combustion process, we get free active hydrogen from water even at a temperature much lower than 1000° C. The equilibrium of a hydrogenation reaction according to Le Chatelier's principle shifts to the left ($2H_2O \leftrightarrow 2H_2+O_2-136$ kcal), helping to enhance the hydrogenation of coal breakdown, while an additional oxidant—oxygen—is also released, which contributes to improved oxidation and, as a result, more complete combustion of the fuel. Apparently, thanks to the effect of the additive of the present invention, the amount of hydrogen in the combustion mixture increases sharply, correspondingly increasing the calorific value Q during fuel combustion. At the same time, with the appearance of extra oxygen generated, it is possible to reduce the amount of gas that needs to be put into the furnace, which is equivalent to reducing the amount of gas emitted.

Fourth, it is known that the composition of air consists of up to 78% of unburnt nitrogen gas. When the air reaches the combustion zone, it picks up some of the heat, carries it out with exhaust gas, and when heated, it reacts with oxygen, thereby increasing nitrogen oxides ($NO_x$) in the exhaust gas. It has been shown that the introduction of moisture in any form (steam, liquid, or steam mixture) into the air entering the furnace leads to improved combustion of gas and oil fuels and reduced nitrogen oxides emission. For boilers of large capacity, a reduction of 20-25% of $NO_x$ emission is achieved when moisture is introduced into the hot air duct with an amount equal to 1.5-2% of the boiler's nominal capacity (Y. I. Yankilevich "*Adjustment of industrial gas-oil boiler". Moscow "Energoatomizdat" ed.,* 1988, p. 137). It is also known that fuel humidification reduces the benzo(a) pyrene content in the exhaust gas. The presence of benzo (a)pyrene ($C_{20}H_{12}$) or dioxin in the exhaust gas is also very detrimental to the earth's biosphere, just as it is for $NO_x$ or $SO_2$ emission.

The effect of the additive in the high temperature region of fuel combustion in reducing the content of various harmful substances in the exhaust gas can be considered as a complex, versatile, environmentally compatible technology. The use of this technology is also economically justified, since its implementation leads to a more rational use of fuel.

According to the present invention, the additive is injected quantitatively into the furnace's gas supply system, as a solution in demineralized water, through a nozzle.

The ratio of the use of the additive to the amount of coal used for the furnace is from 5-8 mL of additives/ton of coal, equivalent to the ratio of using one liter of additive for 125-200 tons of coal, more effectively one liter of additive for 143-200 tons of coal, most effectively one liter of additive for 167-200 tons of coal.

Experiments related to the practical implementation of the additive for coal-fired boilers have demonstrated that the average fuel saving when using the additive is in the range of 11-12%. It is even proven more effective that the use of the additive for coal-fired boilers significantly reduces the amount of unburnt carbon in fly ash and improves liquid slag handling; cleans furnace surfaces, pipes from soot, dust and ash, which improves heat transfer in furnace and boiler convection units and reduces exhaust pollutants such as $NO_x$, CO.

In particular, when using the additive in clinker kiln, the effect which is brought from replacing fuel of good quality, of high fuel cost, with fuel of low quality, of significantly reduced fuel cost has brought enormous economic efficiency, reduced production costs to 5 billion VND/month (net profit), with a kiln capacity of 5000 tons of clinker/day. Not only that, using the additive helps to significantly reduce slag sticking to the furnace, ensuring stable operation of the furnace, ensuring furnace capacity, even when using very bad quality fuel.

EXAMPLES

The invention will be better understood from the following examples. These examples are for illustrative purposes only and do not limit the scope of the patent.

Example 1: Production of the Additive

Step 1: Prepare the Activator Component

The mixture consists of 22.5 kg of 1-(1H-benzo[d]imidazol-2-yl)-3-(5-((diphenylamino)methyl)-1,3,4-oxadiazol-2-yl) propane-1-on compound (95%) and 127.5 kg of carbamite compound (98%), in 350 kg of ethyl lactate solvent, stirred at a speed of 100-200 rpm (arm stirrer) for 30 min, so that the components are completely dissolved into the solution. 500 kg of the activator component is obtained as a solution with a concentration of 30% by mass.

Step 2: Prepare the Active Component

In a stirring apparatus, prepare 700 kg of an 80% solution of iso-popanol in demineralized water. Next, the above iso-propanol solution is added to a mixture of 100 kg of ammonium carbonate salt, 200 kg of salt selected from ammonium acetate salt, ammonium propionate salt, ammonium butyrate salt, or ammonium pentanoate salt. Stir the mixture at a speed of 100-200 rpm (arm stirrer) for 20 minutes, so that the components are completely dissolved into the solution, then the active component is obtained.

Step 3: Prepare the Auxiliary Component

Stir the mixture of 64 kg of technical urea (>99%) and 96 liters of demineralized water, at a speed of 100-200 rpm (arm stirrer) for 10 min, so that the urea is completely dissolved into the demineralized water. 160 kg of the auxiliary component is obtained as a 40% solution of urea in demineralized water.

Step 4: Prepare the Stabilizing Component

First, a mixture comprising 2 liters of an ester selected from a group of ethyl acetate (>99%), ethyl lactate (>98%) or ethyl levulinate (>98%), and 16 liters of isopropanol is stirred with an arm stirrer for about 10 min to obtain 18 liters of mixture A as a homogeneous mixture.

Next, the mixture comprising 1 liter of methyl ester of vegetable oil fatty acid (ester content >98%) and 1 liter of glycerol triacetate ester (>99%) is stirred with an arm stirrer for about 10 min to obtain 2 liters of mixture B as a homogeneous mixture.

Add 2 liters of mixture B obtained above to 18 liters of mixture A obtained above, to obtain 20 liters of mixture C. Mix mixture C with high-power ultrasonic transducer (20 kHz) for 2 min to homogenize the mixture, then obtain a stable composition, comprising a vegetable oil fatty acid methyl ester, a glycerol triacetate ester, an ester selected from a group of ethyl acetate, ethyl lactate or ethyl levulinate, and isopropanol, with the corresponding volume ratio of 5%:5%:10%:80%.

Step 5: Mix the Main Components

Add the activator component, auxiliary component, and stabilizing component in turn to the active component already in a stirring apparatus. Each time a new component is added, stir the mixture at a speed of 100-200 rpm (arm stirrer) for 20 min. Finally, the mixture is treated with a high-power ultrasonic transducer (20 kHz) for 2 min to obtain a transparent, homogeneous mixture.

Step 6: Add the Solvent

In a stirring apparatus, a mixture of isopropanol and butanol solvents is added to the mixture obtained in step 5. Stir the mixture at a speed of 100-200 rpm (arm stirrer) for 20 min to obtain an additive as the final product.

Example 2

Production of the additive with component (% mass):
Activator component: 25
Active component: 55
Auxiliary component: 8
Stabilizing component: 1
Solvent: 11
according to the following process:

Add 440 liters of active component obtained in example 1, 64 liters of auxiliary component obtained in example 1, 8 liters of stabilizing component obtained in example 1 to 200 liters of activator component obtained in example 1 already in a stirring apparatus with a volume of 1000 liters (equivalent to a working volume of 800 liters). Each time a new ingredient is added, stir the mixture at a speed of 120 rpm for 20 min. Finally, the mixture is treated with a high-power ultrasonic transducer (20 kHz), by circulating the mixture through the ultrasonic chamber as long as the retention time of the mixture reached 2 min.

Next, 88 liters of solvent mixture comprising isopropanol and butanol with a volume ratio of 70%:30% are added to the above mixture. Stir the mixture at a speed of 120 rpm for 20 min, obtaining 800 liters of additive.

The following table presents the results of analysis of physicochemical properties of the above additives.

| No. | Criteria | Result | Method |
|---|---|---|---|
| 1 | Color | Colorless | By eyes |
| 2 | Clarity | Transparent | By eyes |
| 3 | Closed cup flash point, in ° C., min | 19 | ASTM D56-16a |
| 4 | Density at 15° C., in g/cm$^3$ | 0.8674 | ASTM D4052-18a |
| 5 | pH value | 7.75 | ASTM E70-19 |

Example 3

Production of the additive with component (% mass):
Activator component: 26
Active component: 56
Auxiliary component: 9
Stabilizing component: 1
Solvent: 8
following the process as described in example 2, but with variable mass of components, respectively, with corresponding values of 208 liters of activator component obtained in example 1, 448 liters of active component obtained in example 1, 72 liters of auxiliary component obtained in example 1, 8 liters of stabilizing component obtained in example 1.

Next, add 64 liters of solvent comprising isopropanol and butanol with a volume ratio of 90%:10% to the above mixture. Stirr the mixture at a speed of 120 rpm for 20 min, obtaining 800 liters of additive.

The following table presents the results of analysis of physicochemical properties of the above additives.

| No. | Criteria | Result | Method |
|---|---|---|---|
| 1 | Color | Colorless | By eyes |
| 2 | Clarity | Transparent | By eyes |
| 3 | Closed cup flash point, in ° C., min | 19 | ASTM D56-16a |
| 4 | Density at 15° C., in g/cm$^3$ | 0.8674 | ASTM D4052-18a |
| 5 | pH value | 7.75 | ASTM E70-19 |

Example 4

Step 1: The additive of example 2 is mixed with demineralized water to form an additive solution of 0.7% by volume.

Step 2: Spray this additive solution into the combustion chamber of a chain grate coal-fired boiler, with a capacity of 8 tons of steam/h, through the gas supply line to the combustion chamber, with a flow of 333 mL/h. Chain grate furnaces consume an average of 8-10 tons of coal per day (24 hours). With the above parameters, after conversion, the rate of using pure additive is 1 liter of pure additive used for 143 tons of coal. The parameters as well as the obtained results are presented in the table below.

| No. | Parameter | Unit | Non-additive | When using the additive | Effciency (when using additive) (Increase/Decrease) |
|---|---|---|---|---|---|
| 1 | Concentration of additive in water | % | — | 0.7 | — |
| 2 | Flow rate of additive pumped into furnace | mL/h | 0 | 333 | — |
| 3 | Burning speed | Rpm | 600 | 600 | — |
| 4 | Coal layer thickness | mm | 70 | 70 | — |
| 5 | Furnance pressure | −Pa | −5 | −5 | — |
| 6 | Average temperature of exhaust gas | ° C. | 243 | 246 | (Increase) 3° C. |
| 7 | Average steam pressure in the furnance | MPa | 0.63 | 0.71 | (Increase) 12.6% |
| 8 | Average furnance temperature | ° C. | 630 | 660 | (Increase) 30° C. |
| 9 | Coal consumption (During the test period) | Ton | 25.62 | 23.45 | — |
| 10 | Amount of steam generated (During the test period) | Ton | 211 | 216 | — |
| 11 | Amount of steam generated from a ton of coal | Ton/ton | 8.24 | 9.21 | (Increase) 11.77% |
| 12 | Total amount of boiler slag during the test | Kg | 4266 | 3393 | — |
| 13 | Amount of slag generated when producing 1 ton of steam | Kg/ton | 20.22 | 15.71 | (Decrease) 22.30% |

The obtained results show that using additive increases the generated fuel steam efficiency by 11.77%, from 8.24 tons of steam/ton of coal to 9.21 tons steam/ton of coal. Not only that, the average furnace temperature increases by 30° C. when using additive, while the exhaust gas temperature is almost unchanged whether the additive is used or not. This proves that the additive helps combustion process to take place effectively in the combustion zone. As a result, in the case of using additive, the furnace efficiency increases significantly, not only reflected through the increase in the amount of steam generated per unit of fuel, but also through the 12.6% increase of the average steam pressure in the boiler. Besides, the amount of slag generated when producing one ton of steam is also significantly reduced (22.3%), in the case of using additive.

The measurement results of gas emission from the boiler when using the additive compared to when not using the additive are presented in the table below.

It is interesting to see that the presence of the additive significantly reduces the concentration of CO and $NO_x$ pollutants in the exhaust gas. Specifically, when using the additive, the CO and No x content in the exhaust gas decreased by 74.9% and 11.2% respectively compared to when not using the additive. The $CO_2$ content in the exhaust gas was almost unchanged (reduced by 1.8%). This result again shows that the additive has the effect of promoting the complete oxidation of the fuel in the furnace.

| | | Content in the exhaust gas | | Emission reduction | Threshold |
|---|---|---|---|---|---|
| Gas | Unit | Non-additive | When using the additive | efficiency when using the additive (%) | specified in QCVN 19: 2009/BTNMT |
| NOx | mg/Nm$^3$ | 219.00 | 194.27 | 11.2 | 850 |
| CO | mg/Nm$^3$ | 129.00 | 32.30 | 74.9 | 1000 |
| $CO_2$ | % khô | 5.5 | 5.4 | 1.8 | — |

The results of visual assessment of the cleanliness of the combustion chamber surface of the chain grate showed a clear difference in the case of no additive and the use of additive. Specifically, when no additive is used, the surface of the combustion chamber is covered with soot. After using the additive (from about 24 hours onwards), the surface of the combustion chamber becomes free of soot; and soot does not stick to the surface of the combustion chamber during the use of the additive.

Example 5

Step 1: The additive of example 2 is mixed with demineralized water to form an additive solution of 1.3% by volume.

Step 2: Spray this additive into the combustion chamber of the biomass fluidized bed boiler through the gas supply line to the combustion chamber, with a flow rate of 720 mL/h. The biomass fluidized bed boiler can be operated with coal dust or biomass fuel (rice husk, sawdust), with a capacity of 8 tons of steam/h, with an average consumption norm (in the case of Indonesian coal dust) of about 240 kg of coal/ton of steam. With the above parameters, after converting, it is determined that the ratio is 1 liter of pure additive used for 200 tons of coal. The parameters as well as the obtained results are presented in the table below.

| Parameter | Non-additive | When using the additive |
|---|---|---|
| Coal consumption norm (kg of coal/ton of steam) | 240 | 217 |

From the above results, it is determined that the coal saving efficiency that the additive brings is 9.5%. Before the test, soot sticks a lot on the wall of the combustion chamber, even at times leading to a blockage in the furnace. After using the additive, the challenge of soot on the furnace wall was completely overcome. The surface of the combustion chamber is clean, free of soot, and the furnace operates stably during the test (60 days). The content of CO and NO x in the exhaust gas decreased by 72.7% and 11.1%, respectively.

Example 6

Step 1: The additive of example 3 is mixed with demineralized water to form an additive solution of 1.3% by volume.

Step 2: Spray this additive solution directly into the clinker kiln whose capacity is 5,000 tons of clinker/day, through air and coal nozzles, with a flow rate of 6,000 mL/h)—equivalent to the usage norm of 1 liter of pure additive for 125 tons of coal. Clinke production technology is FLSmidth technology, with FLSmidth clinker kiln, which is a 2-pedestal kiln, with the inner diameter of 5 m, the length of 60.7 m, the volume of 484 tons (including 6 segments). The furnace is designed to be suitable for coal dust 4a and 5a, but operates most stably with coal dust 4a.

Characteristics of solid fuels, including coal dust 4a, 5a (Hon Gai Coal—Quang Ninh, Vietnam) and bad-quality coal that is solid residue product obtained from pyrolysis/cracking of waste rubber (imported) export), hereinafter referred to as "pyrolysis coal", used daily, as well as during testing, are presented in the table below. Thus, it can be seen that pyrolysis coal fuel has a much lower calorific value than coal dust 4a and 5a.

| Characteristic | Coal dust 4a | Coal dust 5a | Pyrolysis coal |
|---|---|---|---|
| Volatile, dry matter content (%) | 6.5 | 6.5 | — |
| Total dry sulfur content, dry(%) | 0.65 | 0.65 | <3 |
| Particle size ratio 0-5 mm (%) | — | — | >90 |
| Total moisture content (%) | 8.0 | 8.0 | 8.5 |
| Total calorific value (kcal/kg) | 6,400 | 5,600 | 5,100 |

The optimal operating mode in terms of fuel costs of clinker kilns before additive testing is to use a fuel combination comprising 75% by weight of coal dust 4a and 25% by weight of pyrolysis coal. In other words, the proportion of 25% by mass of pyrolysis coal in the fuel combination is the highest possible ratio to ensure stable operation of the clinker kiln in terms of productivity and quality. With any combination of coal dust 4a and pyrolysis coal with a mass fraction of pyrolysis coal above 25%, the clinker kiln cannot operate stably.

The effect of enhancing fuel combustion efficiency in clinker kilns, in the presence of the additive, was evaluated through monitoring the operating parameters of the clinker kiln. When the additive is used, fuel combinations that are worse in quality than the currently used fuel will be introduced in turn. The optimal fuel option is the one at which it is possible to operate with the "highest limit" of the bad fuel ratio while ensuring the production capacity and product quality as required and the completely stable furnace operation.

With such an approach, from the test results with different fuel options obtained, it is found that:

First, when no additive is used, the kiln operates stably with the following fuel options: 100% coal dust 4a (100% 4a); 75% coal dust 4a with 25% pyrolysis coal (75% 4a+25% pyrolysis coal); 100% coal dust 5a (100% 5a).

Second, when using the additive, the furnace operates stably with the options in which the "limit" of the bad fuel ratio is the highest, as follows: 70% coal dust 4a with 30% pyrolysis coal (70% 4a+30% pyrolysis coal); 80% coal dust 5a with 20% of pyrolysis coal (80% 5a+20% pyrolysis coal).

Thus, the presence of the additive allows either increasing the ratio of pyrolysis coal burning with coal dust 4a from 25% to 30%, or increasing the ratio of pyrolysis coal burning with coal dust 5a from 0% to 20%, compared to not using additives. These extremely interesting results, which can be explained by the additive's ability to provide active sites of free radicals (H), help the combustion process in the clinker kiln take place at a much faster rate than combustion without the use of additive; The combustion of hydrocarbons becomes more complete with the release of triatomic gases ($CO_2$, $H_2O$); Carbon soot is formed in the flame more quickly, giving more brilliance to the flame, leading to an increase in the core temperature of the flame and a higher rate of radiant heat transfer, which is hundreds of times more efficient in radiation heat transfer than the standard convection process efficiency. Thus, in order to maintain the temperature in the furnace as of the option without using the additive, it is possible to replace solid fuel of good quality with solid fuel of worse quality. The additive helps both burn coal more exhausted, thereby generating higher heat, and transfer heat much more efficiently, so the combustion process becomes more efficient.

The economic efficiency calculation results of the tested options are presented in the table below. The unit price of fuel at the time of testing is as follows: the coal dust 4a costs 4,030 VND/kg; the coal dust 5a costs 3,190 VND/kg; the pyrolysis coal costs 1,425 VND/kg; the additive costs 15,000,000 VND/liter.

| Option | Consumption rate, dry (kg/ton) | | | Additive (liter/day) | Total fuel consumption (kg/ton) | Total cost (VND/ton) | Cost reduction compared to using 100% coal dust 4a (VND/ton) |
|---|---|---|---|---|---|---|---|
| | Coal dust 5a | Coal dust 4a | Pyrolysis coal | | | | |
| Non-additive | | | | | | | |
| 100% 4a | 0 | 126.6 | 0 | 0 | 126.6 | 557,428.3 | — |
| 100% 5a | 144.6 | 0 | 0 | 0 | 144.6 | 504,274.0 | 53,154.27 |
| 75% 4a + 25% pyrolysis coal | 0 | 107.4 | 27.4 | 0 | 134.8 | 515,821.2 | 41,607.08 |
| When using the additive | | | | | | | |
| 80% 5a + 20% pyrolysis coal | 125.8 | 0 | 24.1 | 2 | 149.9 | 482,178.8 | 75,249.48 |
| 70% 4a + 30% pyrolysis coal | 0 | 102.4 | 33.6 | 2 | 136.0 | 509,337.4 | 48,090.86 |

It is interesting to find that the additive used for the combustion process in the clinker kiln yielded superior economic efficiency compared to not using the additive. The results show that the option of using 80% of coal dust 5a and 20% of pyrolysis coal when using the additive is the optimal option in terms of economic efficiency and:

Reducing the cost of solid fuel compared to the option of using 100% of coal dust 5a (without the additive) is 22.095 VND/ton of clinker.

Reducing the cost of solid fuel compared to the option of using 100% of coal dust 4a (without the additive) is 75.249 VND/ton of clinker.

Reducing the cost of solid fuel compared to the option of using 75% of coal dust 4a and 25% of pyrolysis coal, without the additive (the option that is being chosen to operate at the factory—the control option) is 33.642 VND/ton of clinker.

Reducing the cost of solid fuel compared to the option of using 70% of coal dust 4a and 30% of pyrolysis coal when using the additive is VND 27.158/ton of clinker.

The current capacity of the kiln is 5,000 tons of clinker/day. Basically, the plant operates no less than 300 days/year. From that, it can be calculated that the economic efficiency (net profit) obtained (through the reduction of the cost of solid fuel for the production of one ton of clinker) when using the additive is not less than 50 billion VND/year, compared to when no additive is used.

In particular, during the test, the soot sticking to the kiln wall situation was significantly reduced. Because the clinker production technology must ensure that there is no CO gas in the clinker kiln, it is not possible to evaluate the reduction of CO emission in this case. At the same time, the clinker kiln according to FLSmidth technology is the most modern generation in the world today, with the exhaust gas treatment mode to meet the most stringent requirements, so the determination of NOx content in the exhaust gas when using the additive is not significant compared to when no additive is used.

Advantages of Invention

The additive in the present invention provides the following multi-faceted benefits:

The present invention helps to improve the economic-technical and environmental efficiency of the solid fuel combustion process (coal, biomass) in the furnace at the same time, thanks to its ability to improve fuel efficiency and reduce fuel consumption, its feature of preventing combustion chamber wall deposits and reducing pollutant emission, and ensuring stable and highly efficient operation of the furnace even when using bad-quality fuel. Therefore, the presence of the additive in solid fuel combustion process not only contributes directly to economic efficiency by reducing fuel costs through reduced fuel consumption and/or stable operation even when replacing partly or all of good-quality fuel at high cost, with degraded-quality fuel at low and very low cost, but also contributes to reducing maintenance and maintenance costs, and prolongs the life of the furnace by significantly increasing the time between slag removal, which simplifies the work, as well as does not cause wear and damage to the surface to be cleaned. Besides, the additive also brings a "dual" effect of protecting the environment thanks to the economical and efficient use of fuel, and at the same time of significantly reducing pollutant emission from the operation of the boiler using solid fuel.

The present invention can be easily applied to furnace using solid fuel, by quantitatively injecting through the nozzle into the gas/solid fuel supply line without any further modification or investment in any complex and expensive infrastructure. The total cost of such a feeding system for one furnace is no more than $3,000, regardless of capacity. The additive is used for the furnace with a very low ratio to fuel, equivalent to a ratio of 5-8 mL of additive per ton of solid fuel. The net profit (after deducting the cost of buying the additive and costs related to using the additive) when using the additive in the present invention for clinker kilns, with a capacity of 5000 tons of clinker/day is over VND 50 billion/year, not to mention the indirect benefits to the environment, as well as the benefits brought about by reducing maintenance costs, maintenance, periodical furnace slag removal.

The production process of the additive in the present invention can be carried out simply, without the need for complicated production equipment, allowing the production to bring economic-technical and environmental efficiency, superiority to the currently known products.

I claim:

1. An additive for solid fuel combustion comprising following components (% mass):

activator component: 20-30,
active component: 50-60,
auxiliary component: 5-9,
stabilizing component: 1-5, and
solvent: suitable, in which, the activator component is a mixture of highly polar substances, including benzimidazole molecule with oxadiazole ring, the active component is a solution containing 1 mass fraction of an ammonium salt of carbonic acid, 2 mass fractions of an ammonium salt of a carboxylic acid with 2 to 5 carbon atoms, in demineralized water;

the auxiliary component includes urea and demineralized water;

the stabilizing is a mixture of fatty acid alkyl esters, glycerol esters, organic acid esters with 2, 3 or 5 carbon atoms, and isopropanol;

the solvent is a mixture of isopropanol and butanol.

2. The additive according to claim 1, characterized in that, the active component is benzimidazol carrying oxadiazol diethylamino methyl, diphenylamino methyl, 4-methylpiperazine-1-yl methyl derivatives.

3. The additive according to claim 1, characterized in that, the active component is 1-(1H-benzo[d]imidazol-2-yl)-3-(5-((diphenylamino)methyl)-1,3,4-oxadiazol-2-yl) propan-1-on.

4. The additive according to claim 1, characterized in that, the active component is a solution containing 1 mass fraction of ammonium carbonate salt, 2 mass fractions of ammonium salt selected from the group of ammonium acetate, ammonium propionate, ammonium butyrate, ammonium pentanoate, in demineralized water.

5. The additive according to the claim 1, characterized in that, the stabilizing component is a mixture comprising fatty acid alkyl esters from vegetable oil, glycerol esters triacetate, esters selected from a group of ethyl acetate, ethyl lactate or ethyl levulinate, and isopropanol mixed together in a volume ratio of 5%:5%:10%:80%, respectively.

6. The additive according to the claim 1, characterized in that, the solvent is a mixture of isopropanol and butanol mixed together in a volume ratio of 50%:50%, more preferably 70%:30%, most preferably 90%:10%.

7. The production process of the additive for solid fuel combustion according to claim 1, characterized in that, comprising the following steps:

(i) preparing the activator component:

mixing a solution containing a mixture comprising benzimidazole molecule with oxadiazole ring and carbamite compound in a solvent selected from a group of the organic solvents ethyl acetate, ethyl lactate, preferably ethyl lactate, to obtain a 20-40% solution containing a mixture of of benzimidazole molecule with oxadiazole ring and carbamite compound in the solvent;

(ii) preparing the active component:

a mixture comprising 1 mass fraction of ammonium carbonate, 2 mass fractions of ammonium salt of a carboxylic acid selected from a group of ammonium acetate, ammonium propionate, ammonium butyrate, or ammonium pentanoate, added to an 80% solution of iso-propanol in demineralized water, combine with stirring to obtain the active component with a salt concentration of 30%;

(iii) preparing the auxiliary component:

stirring the mixture including urea in demineralized water to the auxiliary component in the form of a 40% solution of urea in demineralized water;

(iv) preparing the stabilizing component:

first, preparing mixture A comprising an ester of an organic acid with 2, 3, or 5 carbons selected from a group of ethyl acetate esters, ethyl lactate or ethyl levulinate esters, and isopropanol, respectively, in a volume ration of 1:8, then stir to obtain a homogeneous mixture;

next, preparing mixture B comprising methyl ester of fatty acids from vegetable oil and glycerol triacetate ester in a volume ratio of 1:1, stirring to obtain a homogeneous mixture;

then, adding mixture B to mixture A, in a volume ratio of 1:9 to obtain mixture C, stir mixture C to homogenize the mixture, obtain the stabilizing component comprising a mixture of vegetable oil fatty acid methyl esters, glycerol triacetate esters, organic acid esters with 2, 3 or 5 carbons selected from a group of ethyl acetate esters, ethyl lactate or ethyl levulinate, and isopropanol, according to the respective volume ratio of 5%:5%:10%:80%;

(v) adding the activator component, the auxiliary component, the stabilizing component obtained above to the active component in turn, with the ratio (% mass):
activator component: 20-30,
active component: 50-60,
auxiliary component: 5-9,
stabilizing component: 1-5;

then, stirring to obtain a homogeneous, transparent mixture, followed by the addition of solvent in the form of a mixture of isopropanol and butanol in suitable quantities to the resulting mixture to obtain the additive.

* * * * *